US005601501A

United States Patent [19]

Kobayashi

[11] Patent Number: 5,601,501

[45] Date of Patent: Feb. 11, 1997

[54] IRON TYPE GOLF CLUB HEAD

[75] Inventor: Kenji Kobayashi, Tsubame, Japan

[73] Assignee: K.K. Endo Seisakusho, Japan

[21] Appl. No.: 538,296

[22] Filed: Oct. 2, 1995

[30] Foreign Application Priority Data

Aug. 1, 1995 [JP] Japan ..... 7-196725

[51] Int. Cl.[6] ..... A63B 53/04

[52] U.S. Cl. ..... 473/350

[58] Field of Search ..... 273/167 H, 167 E, 273/173, 167 J; 473/329, 342, 345, 346, 350

[56] References Cited

U.S. PATENT DOCUMENTS 5,090,702 2/1992 Viste ..... 273/167 H

FOREIGN PATENT DOCUMENTS 60-177867 11/1985 Japan .
2-241469 9/1990 Japan .

*Primary Examiner*—George J. Marlo
*Attorney, Agent, or Firm*—Quarles & Brady

[57] ABSTRACT

An iron-type golf club head having plural cavities formed in a back surface of a head body. A back surface 1A of a metallic head body 1 is formed with plural cavities 5, each being formed semispherical and opposite to a face 4 of the head body 1. The cavities 5 are formed by forging, thus forming even and fine tissues and grain flow. Further, according to a preferred embodiment of the invention, the cavities 5 are disposed regularly on the back surface 1A Accordingly, the toughness and durability of material can be enhanced, so that face 4 can be made thinner to a 1.0 to 3.5 mm thickness for optimal weight distribution. As a result, a larger sweet area can be realized without damaging a strength of head.

9 Claims, 7 Drawing Sheets

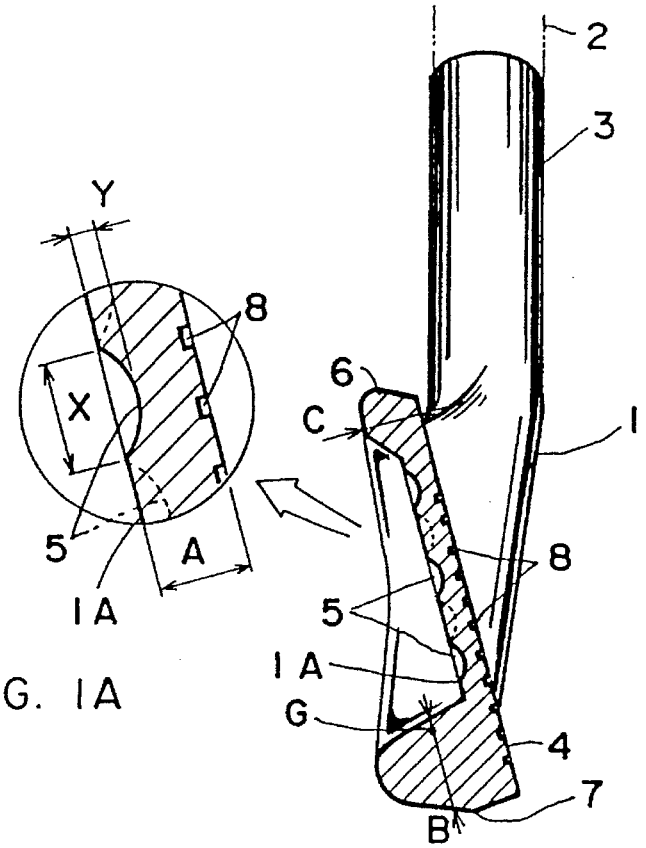
FIG. 1
FIG. 1A
FIG. 2
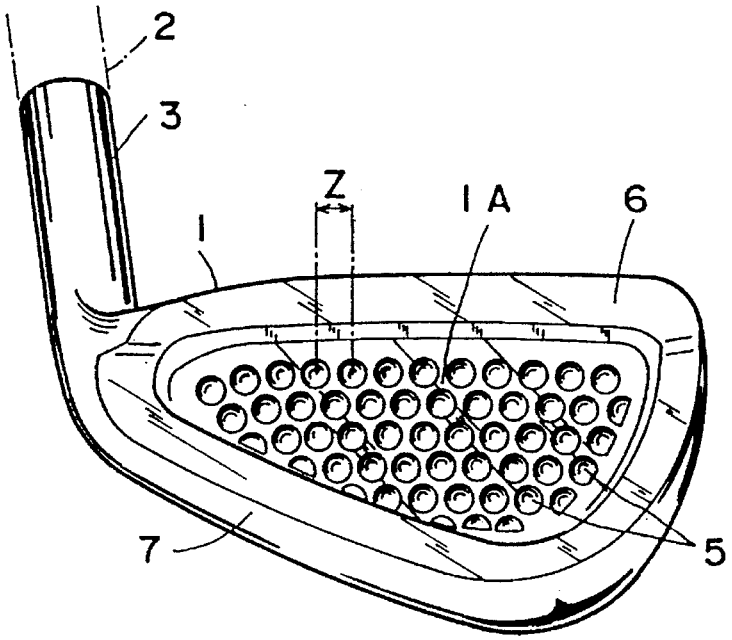

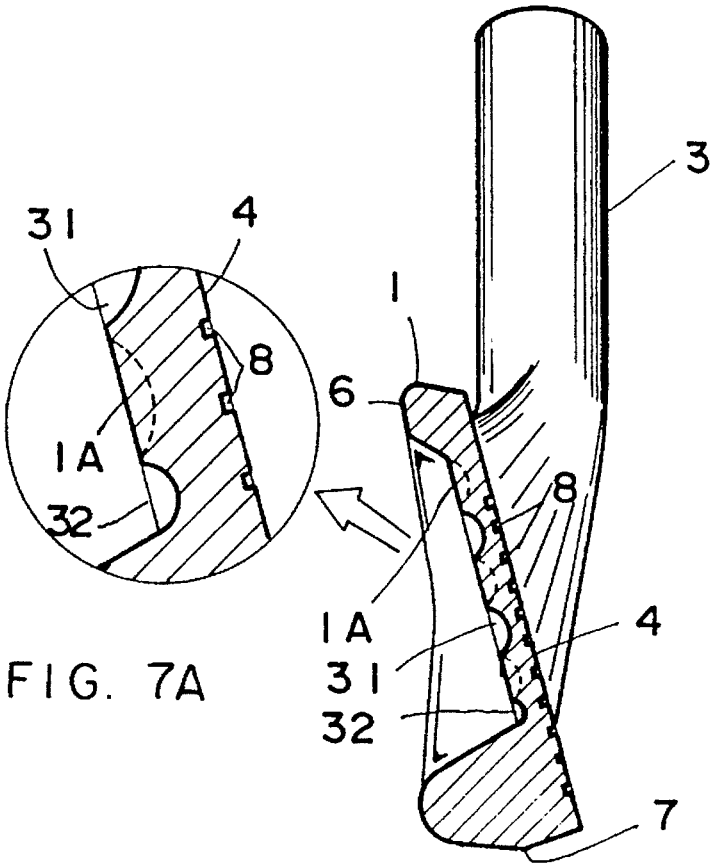
FIG. 7
FIG. 7A
FIG. 8
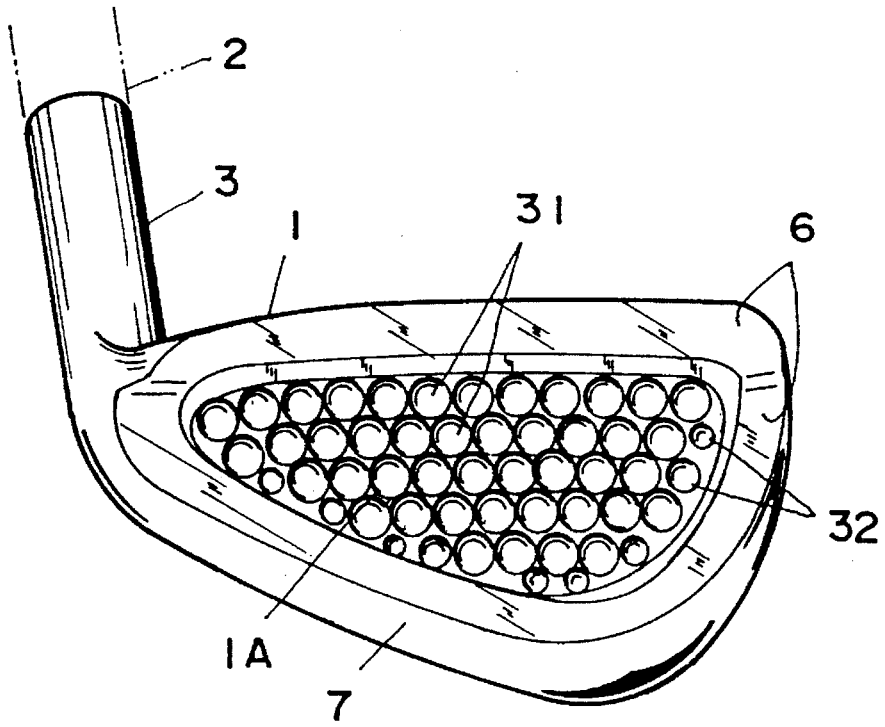

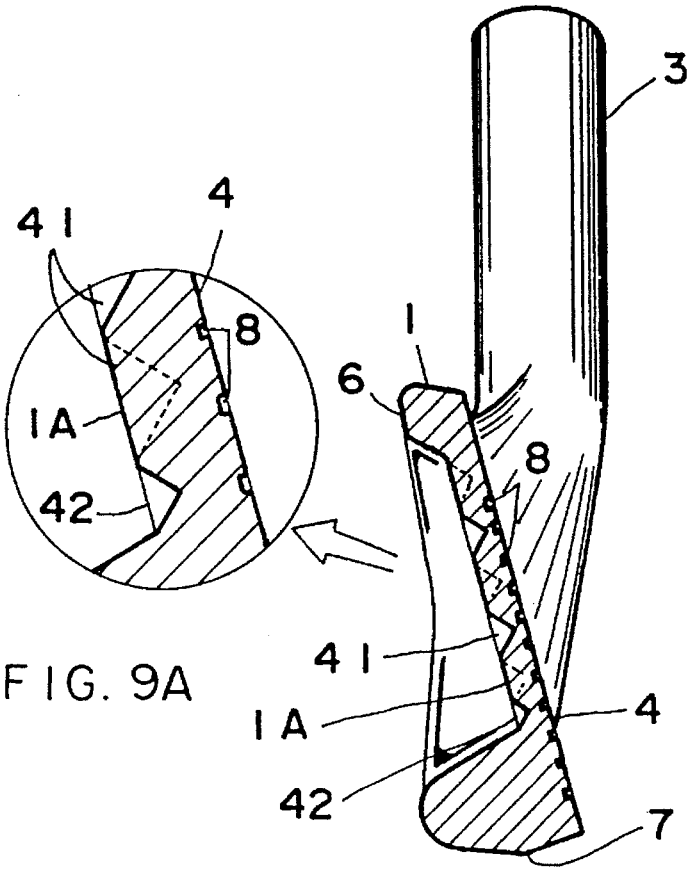
FIG. 9
FIG. 9A
FIG. 10
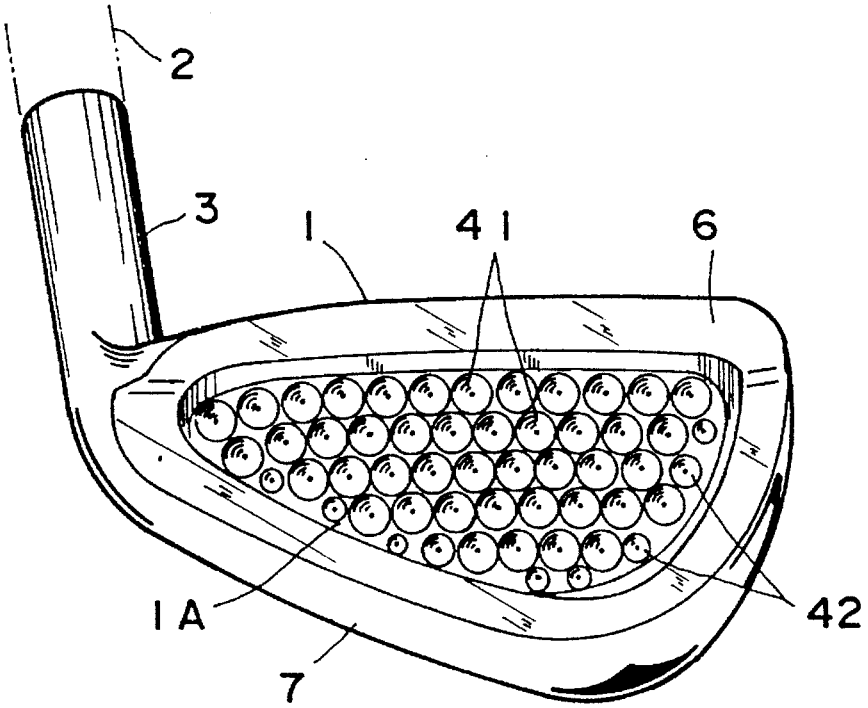

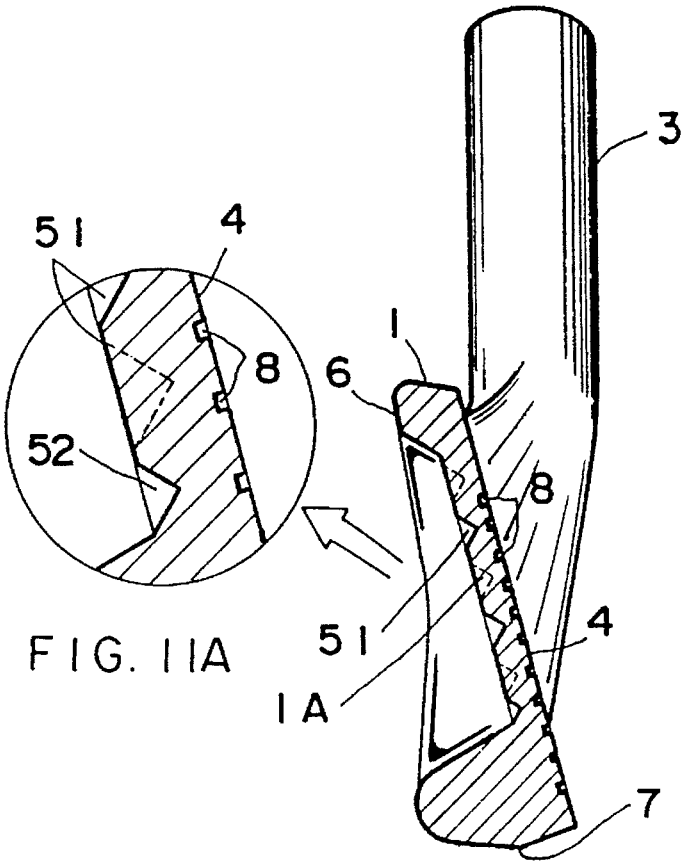
FIG. 11
FIG. 11A
FIG. 12
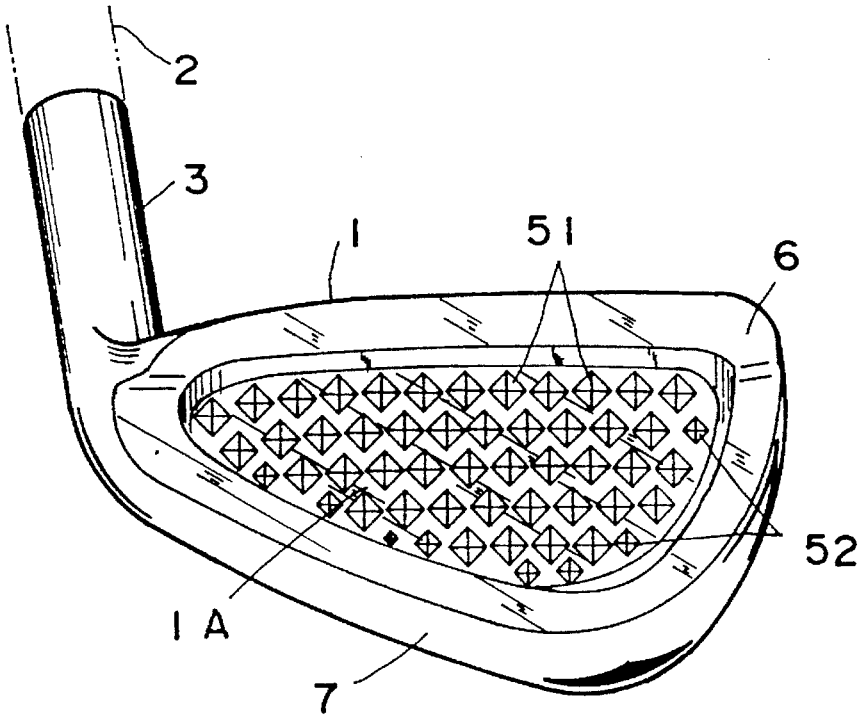

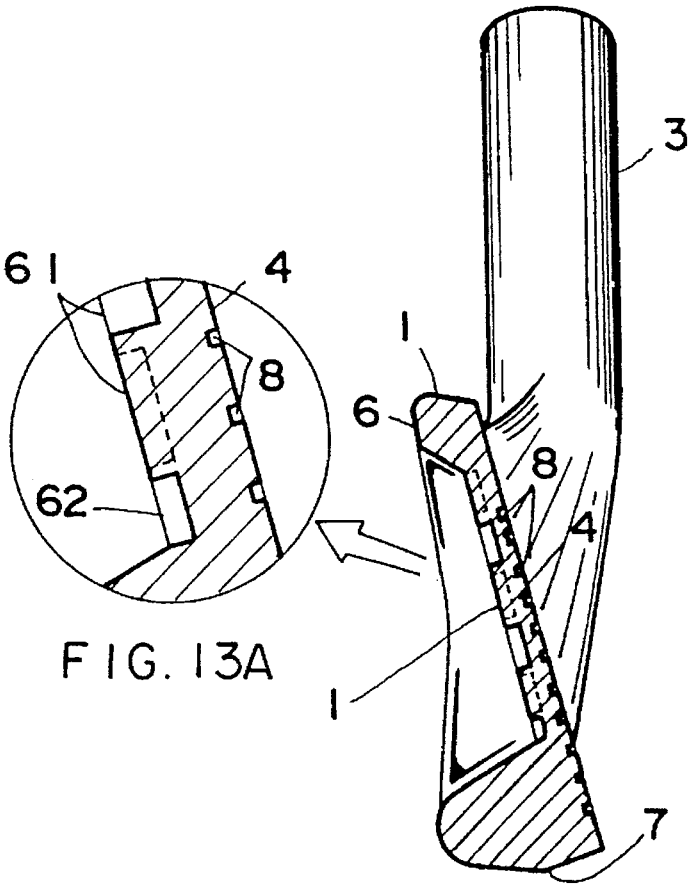
FIG. 13
FIG. 13A
FIG. 14
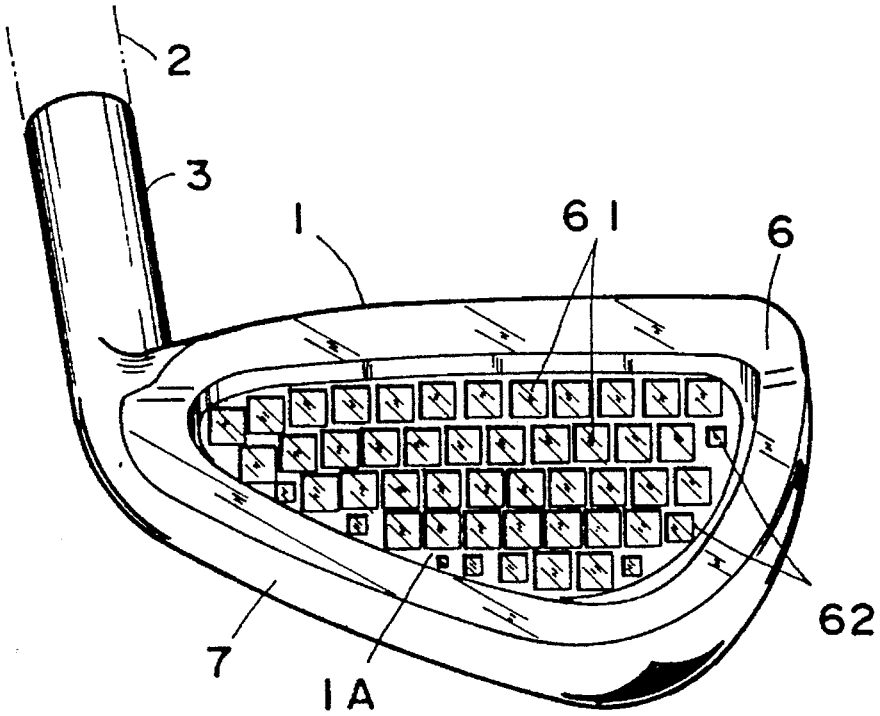

IRON TYPE GOLF CLUB HEAD

BACKGROUND OF THE INVENTION (a) Field of the Invention

The present invention relates to an iron-type golf club head such as an iron, sand wedge or pitching golf club head.

(b) Description of Prior Art

For this kind of golf club head, there is proposed a golf club head disclosed in Japanese U.M.Appln Laid-Open No. 60-177867, which discloses in FIG. 2, a golf club head having multiple cavities at its back. The prior golf club head aimed at decreasing air resistance when swinging the same by forming multiple cavities at the back of the head body which had been conventionally formed smooth. Futher, there is also proposed another golf club head disclosed in Japanese Patent Appln Laid-Open No.2-241469, which discloses in FIG. 1, a wood-type golf club head having small cavities formed along a peripheral portion of the head body by cutting process. According to the latter prior golf club head, the said small cavities could enchance a sense of beauty.

Whereas, it is widely recognized that for enlargement of so-called sweet area, iron-type golf club head (hereinafter called head) should have an elongated distance between the CG of the head body and the face, or otherwise, should have the weight distribution dispersed toward the periphery thereof by thickening an edge of the face. However, according to the prior golf club heads, the face must be formed to a preset thickness because of requirement for the strength at the time of striking balls, therefore, a predetermined weight would be inevitably required for the ensuring of the thickness of the face. As a result, there has been a problem such that a golf club head can not be formed as you like.

SUMMARY OF THE INVENTION

To eliminate the above-mentioned problems, it is, therefore, an object of the present invention to provide a iron-type golf club head of which the face can be optionally formed when the face is formed thinner.

According to a major feature of the present invention, there is provided a iron-type golf club head comprising: a metallic head body having a shaft attaching portion at one side and a face at its front side; a plurality of cavities formed in a back surface of said head body, corresponding to the face thereof, said cavities being formed by forging.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which:

FIG. 1 is a section showing a first embodiment of the invention.

FIG. 1*a* is an enlarged view of a section of FIG. 1.

FIG. 2 is a perspective view seen from a back of a first embodiment of the invention.

FIG. 7 is a section showing a third embodiment of the invention.

FIG. 7*a* is an enlarged view of a section of FIG. 7.

FIG. 8 is a perspective view seen from a back of a third embodiment of the invention.

FIG. 9 is a section showing a fourth embodiment of the invention.

FIG. 9*a* is an enlarged view of a section of FIG. 9.

FIG. 10 is a perspective view seen from a back of a fourth embodiment of the invention.

FIG. 11 is a section showing a fifth embodiment of the invention.

FIG. 11*a* is an enlarged view of a section of FIG. 11.

FIG. 12 is a perspective view seen from a back of a fifth embodiment of the invention.

FIG. 13 is a section showing a sixth embodiment of the invention.

FIG. 13*a* is an enlarged view of a section of FIG. 13.

FIG. 14 is a perspective view seen from a back of a sixth embodiment of the invention.

DETAILED DESCRIPTION OF THE PREFERRED EMBODIMENTS

Figure 3:
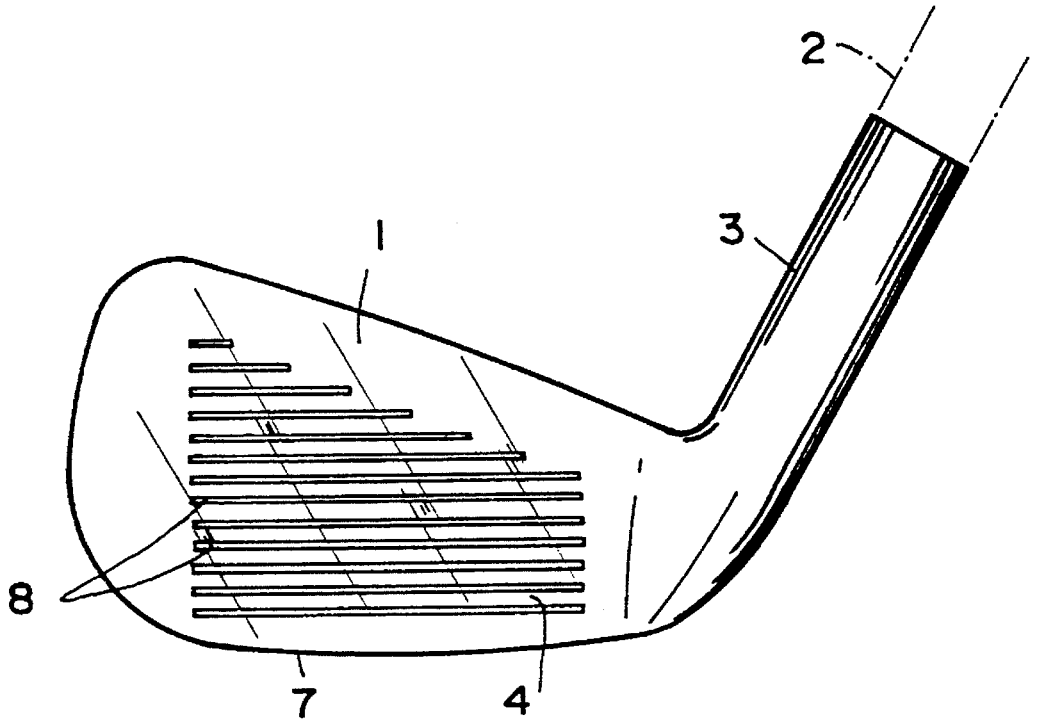
FIG. 3 is a front view showing a first embodiment of the invention.

Hereinafter is described a first embodiment of a golf club head of the invention with reference to FIGS. 1 to 4, in which reference numeral 1 designates a metallic head body. The head body 1 has a hosel 3 for mounting a shaft 2 thereto, and a face 4 for striking balls at its front. A back surface 1A of the head body 1 is formed with stagered arrangement of plural semispherical cavities 5, which is opposite to the face 4 and formed rather dense, while a peripheral edge of the back surface 1A is formed with annular projection 6, of which the lower part constructs a sole 7.

Each of the cavities 5 has a diameter X ranging from 3 to 8 mm, preferably 5 to 6 mm, a depth Y of 0.2 to 1.7 mm, preferably 0.7 to 1.2 mm, while a center to center distance Z between adjacent cavities 5 is 3 to 10 mm, preferably 5 to 7 mm. In addition, percentage area of all the cavities to a flat portion 9 hereinbelow described is preferably 70% or above. Incidentally, reference numeral 8 designates grooves called score lines formed on the face 4.

Hereinafter is described a manufacturing method of a golfclub head of the invention.

Figure 4:
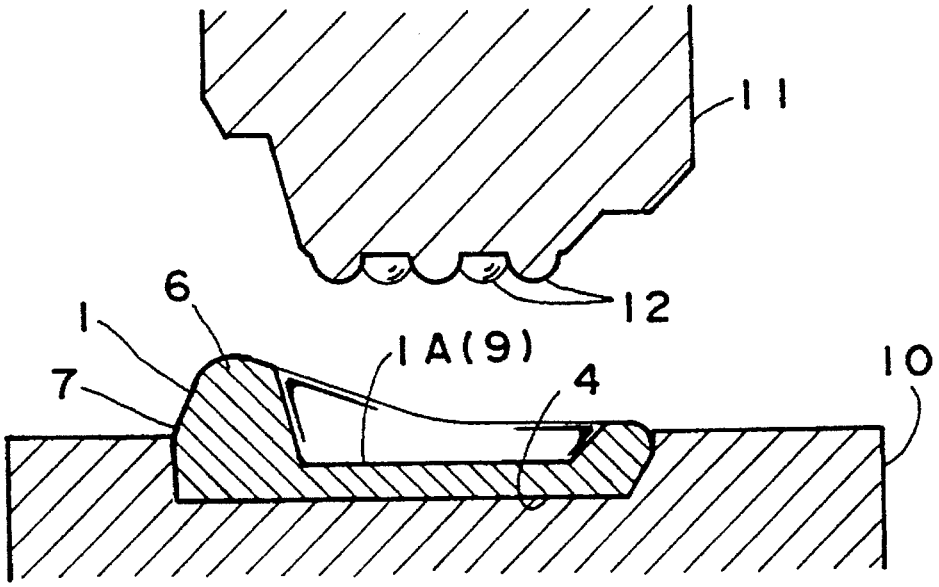
FIG. 4 is an explanatory section illustrating a manufacturing process of a golf club head of a first embodiment of the invention.

For example, as shown in FIG. 4, the face 4, the annular projection 6 of the back surface 1A and the flat portion 9 in the center thereof are each formed beforehand by means of hot or cold forging of carbon steels for machine structural use such as JIS standard S20C or S25C, suitable metal such as titanium, titanium alloy or beryllium copper alloy. Specifically, the above steel products should undergo annealing process after the hot forging. Next, the head body 1 is placed on a lower die 10 of the forging device, while a lower surface of an upper die 11 is formed with convex semispherical protrusions 12 to form the plural cavities 5. Then, the upper die 11 is pressed to the flat portion 9 to simultaneously form plural cavities 5 by cold forging. For the steel products, such cavities 5 may be formed by hot forging. After forming the cavities 5, the grooves 8 are formed, and then, the surface is polished to a final product.

According to a first embodiment of the invention, the back surface 1A of the head body 1 is formed with plural cavities 5 by forging, whereby the face is strengthened in the neighborhood of the center thereof, thus decreasing the thickness A of the face 4 to about 1.0 to 3.5 mm thickness. As a result, you can distribute a resultant surplus weight for example, to the sole 7 in order to enlarge the thickness B thereof, thereby elongating the distance between the CG of the head body 1 and the face 4 to enlarge a sweet area, or you can also enlarge a sweet area by allotting the surplus weight to the annular projection 6 to make the thickness C greater.

Table 1 shown below indicates the contrast between the results of the tensile tests wherein the plates formed with the equivalents to the cavities 5 (sample Nos.3 and 4) were compared to the plates without the same (sample Nos.1 and 2). Further, the Table 1 also shows the contrast between the results of the bending tests wherein the plate formed with the equivalents to the cavities 5 (sample No.2) was compared to the plate without the same (sample No. 1).

TABLE 1

Tensile Test

| No. | sample No. | material | test piece: dimension mm | test piece: cross-sectional area mm² | original gauge length mm | tensile: load N | tensile: tensile strength N/mm² | yield: load N | yield: yield point N/mm² | yield elongation % | reduction of area % |
|---|---|---|---|---|---|---|---|---|---|---|---|
| 1 | 1 | S20C | 5.8 × 24.5 | 142.1 | 49.9 | 75096 | 528.5 | 52920 | 372.4 | 34.1 | — |
| 2 | 2 | " | 6.0 × 24.3 | 145.8 | 49.6 | 73619 | 504.9 | 54517 | 374.0 | 35.5 | — |
| 3 | 3 | " | 5.8 × 24.5 | 142.1 | 50.1 | 90866 | 639.5 | 63337 | 445.7 | 2.0 | — |
| 4 | 4 | " | 5.8 × 24.4 | 141.5 | 50.0 | 91457 | 646.3 | 62475 | 441.5 | 2.6 | — |

Bending Test

| No. | sample No. | material | test piece: cross-sectional dimension mm | test piece: length mm | angle of bend (deg.) | inside radius mm | bearing distance mm | result crack on the outer periphery of the bent piece | remark |
|---|---|---|---|---|---|---|---|---|---|
| 1 | 1 | S20C | 5.9 × 20.0 | 149.8 | 180 | 12 | 36 | none | deformation - starting load, note1): 4288N |
| 2 | 2 | " | 5.9 × 19.6 | 151.0 | 180 | " | " | fractured | deformation - starting load, note1): 6370N |

notes.
note1)
deformation - starting load was assumed to be a proportional limit in a load-elongation diagram.

According to the result of the tensile test in Table 1, the average tensile strength of the plates with the cavities (sample Nos.3 and 4) was 642.2 N/mm , while that of the plates without the cavities (sample Nos.1 and 2) 516.7 N/mm, which indicated that the forming of the cavities could increase the tensile strength by 24.4%. Whilst, according to the result of the bending test in Table 1, the deformation-starting load of the plate with the cavities (sample No.2) was 6,370 N, while that of the plate without the cavities (sample No.1) 4,288 N, which indicated that the forming of the cavities could increase the bending strength by 48.5%. Such improvement of the strength presumably results from the enhanced toughness and durability of the material associated with the formation of even and fine tissues and grain flows by forming cavities by means of forging. In addition, as the cavities 5 were formed semispherial, the above-mentioned grain flows are hard to disconnect, thereby further improving the strength.

Figure 5:
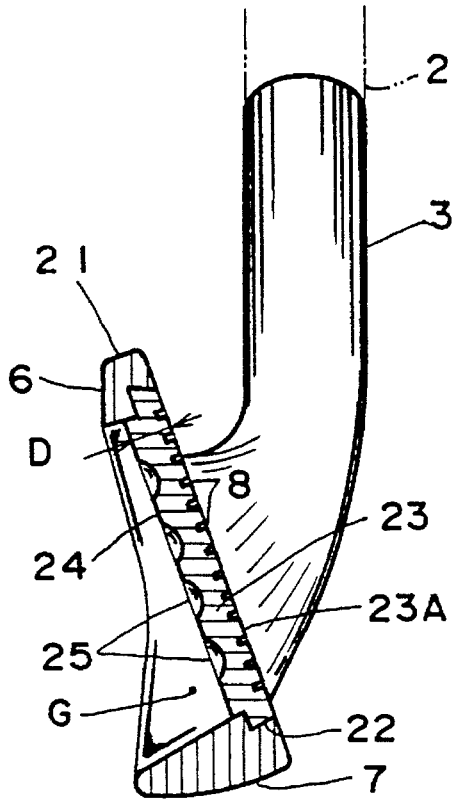
FIG. 5 is a section showing a second embodiment of the invention.
Figure 6:
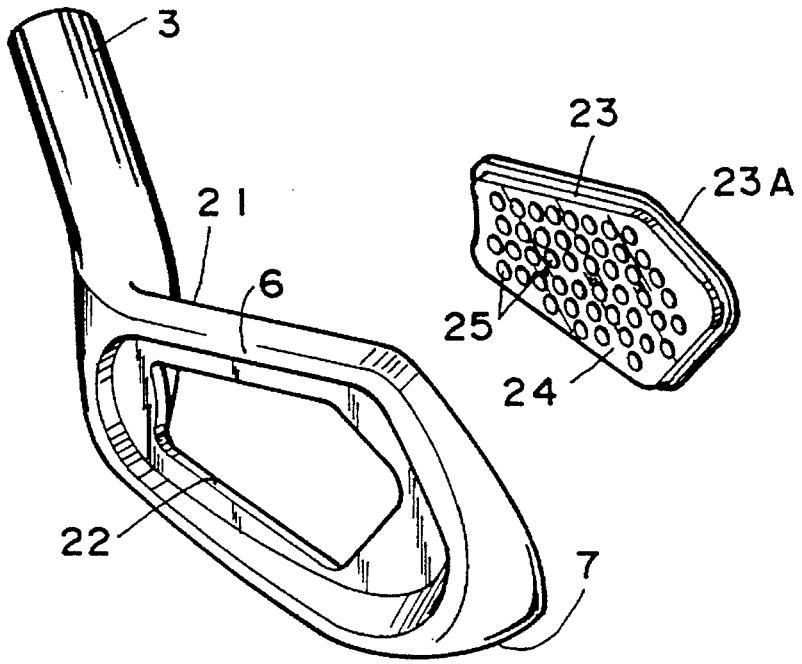
FIG. 6 is an exploded perspective view showing a second embodiment of the invention.

In FIGS. 5 and 6 showing a second embodiment of the invention, the same portions as those described in a first embodiment are designated as common reference numerals, and their repeated detailed descriptions will be omitted.

An iron-type golf club head of a second embodiment of the invention comprises: a head body 21 made of beryllium copper alloy (the specific gravity:approx.8.2); a window aperture 22 defined through a face-equivalent part of the head body 21; a face member 23 having face 23A at its front, said face member 23 being made of suitable material of less specific gravity than the beryllium copper alloy such as carbon steel for machine structural use (the specific gravity:approx.7.8), and said face member being fitted into said window aperture 22. The face member 23 is hot forged, and then, a back surface 24 thereof is formed with cavities 25 by cold forging. Thereafter, the face member with the cavities 25 is fitted into the window aperture 22 of the head body 21. Alternatively, the face member 23 may be first fitted into the window aperture 22 of the head body 21, then the back surface 24 thereof may be formed with the cavities 25 in the same manner as described in a first embodiment.

According to a second embodiment of the invention, the back surface 24 of the face member 23 fitted into the window aperture 22 is formed with plural cavities 25 beforehand, whereby the face member 23 is strengthened, thus making the thickness D of the face member 23 less to an about 1.0 to 3.5 mm thickness. As a result, you can allot a surplus weight thus obtained, for example, to the sole 7 in order to enlarge a sweet area. In addition, as the head body 21 is formed of other material than that of the face member 23, the CG can be positioned still away from the face 23A, thus further enlarging sweet area.

In FIGS. 7 to 8, 9 to 10, 11 to 12 and 13 to 14 showing third to sixth embodiments respectively, the same portions as those described in a first embodiment will be designated as common reference numerals, and their repeated detailed description will be omitted.

Referring to FIGS. 7 and 8 showing a third embodiment, the back surface 1A of the head body 1 is formed with semispherical cavities 31 and 32 having different diameters. The larger-diameter cavities 31 are formed in the back surface 1A, opposite to the neighborhood of the face 4, while the smaller-diameter cavities 32 are formed therein, opposite to the peripheral edge thereof or adjacent the annular projection 6. The cavities 31 and 32 are capable of being densely formed owing to the above difference in diameter.

Referring to FIGS. 9 and 10 showing a fourth embodiment, the back surface 1A of the head body 1 is formed with cone-shaped cavities 41 and 42 having different diameters, thereby forming denser cavities as well.

Referring to FIGS. 11 and 12 showing a fifth embodiment, the back surface 1A of the head body 1 is formed with pyramid-shaped cavities 51 and 52 having different dimensions, thereby forming denser cavities as well.

Referring to FIGS. 13 and 14 showing a sixth embodiment, the back surface 1A of the head body 1 is formed with cavities 61 and 62 having different rectangular sections, thereby forming denser cavities as well.

Incidentally, the present invention should not be limited to the above embodiments, but may be modified within a scope of the invention.

As is evident from the above descriptions, according to the present invention, face can be strengthened when you diminish the thickness thereof, owing to the cavities formed by forging. Accordingly, there can be provided an iron-type golf club head where the diminished thickness of face enables the alotting of the surplus weight thus obtained to other parts of head body, whereby a sweet area can be enlarged and optional weight distribution in head can be realized. In addition, as face is formed within a range of 1.0 to 3.5 mm thickness, the above-described advantages can be effectively attained.

What is claimed:

1. An iron-type golf club head comprising:

a metallic head body having a shaft attaching portion at one side and a face at its front side;

a plurality of cavities formed in a back surface of said head body, each being formed semispherical and opposite to the face thereof, said cavities being formed by forging.

2. An iron-type golf club head according to claim 1, wherein said back surface is a back surface of said face.

3. An iron-type golf club head according to claim 2, wherein a thickness of said face is within a range from 1.0 mm to 3.5 mm.

4. An iron-type golf club head according to claim 2, wherein said cavities are of different dimensions.

5. An iron-type golf club head according to claim 2, wherein each width of said cavities is within a range from 3.0 to 8.0 mm, while each depth thereof is 0.2 to 1.7 mm.

6. An iron-type golf club head according to claim 2, wherein a center to center distance between the adjacent cavities is within a range from 3 to 10 mm.

7. An iron-type golf club head according to claim 2, wherein a percentage area of said cavities to the flat portion of said face is 70% or above.

8. An iron-type golf club head according to claim 2, wherein said head body is formed of carbon steels for machine structural use or suitable metal such as titanium, titanium alloy, beryllium copper alloy by forging.

9. An iron-type golf club head according to claim 2, wherein each semispherical cavity is of the same dimension, and a center to center distance between each cavity is approximately equal.

* * * * *